US010814653B2

(12) United States Patent
Campbell et al.

(10) Patent No.: US 10,814,653 B2
(45) Date of Patent: Oct. 27, 2020

(54) BLOWER ROLL TO ASSIST PAPER DETACK FROM VACUUM TRANSPORTS

(71) Applicant: Xerox Corporation, Norwalk, CT (US)

(72) Inventors: Richard Campbell, Rochester, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 5 days.

(21) Appl. No.: 16/164,277

(22) Filed: Oct. 18, 2018

(65) Prior Publication Data

US 2020/0122492 A1 Apr. 23, 2020

(51) Int. Cl.

| | |
|---|---|
| ***B41J 11/057*** | (2006.01) |
| ***B41J 11/00*** | (2006.01) |
| ***B65H 5/22*** | (2006.01) |

(52) U.S. Cl.

CPC ..... *B41J 11/057* (2013.01); *B41J 11/0085* (2013.01); *B65H 5/224* (2013.01); *B65H 2406/32* (2013.01); *B65H 2406/366* (2013.01)

(58) Field of Classification Search

CPC .. B65H 29/245; B65H 29/246; B65H 29/247; B65H 29/248; B65H 5/224; B65H 2406/32; B65H 2406/366; B41J 11/04; B41J 19/28; B41J 11/057; B41J 11/0085

See application file for complete search history.

(56) References Cited

U.S. PATENT DOCUMENTS

| | | | | |
|---|---|---|---|---|
| 5,150,163 | A | 9/1992 | Durland | |
| 5,548,388 | A | 8/1996 | Schieck | |
| 5,717,446 | A | 2/1998 | Teumer | |
| 6,965,748 | B2 | 11/2005 | Embry | |
| 7,182,334 | B2 | 2/2007 | Spence | |
| 2003/0205153 | A1* | 11/2003 | Wadlinger | B41F 22/00 101/247 |
| 2013/0200563 | A1* | 8/2013 | Clevers | B65H 5/224 271/7 |
| 2016/0152429 | A1* | 6/2016 | La Vos | B41J 11/0085 271/225 |

FOREIGN PATENT DOCUMENTS

| | | | | |
|---|---|---|---|---|
| WO | WO 03/013995 | * | 2/2003 | B65H 23/24 |

* cited by examiner

*Primary Examiner* — Henok D Legesse
(74) *Attorney, Agent, or Firm* — Fay Sharpe LLP

(57) ABSTRACT

A roller for a transport belt of a vacuum transport assembly includes an elongate cylindrical body adapted for a rotatably fixed connection to a vacuum transport assembly. An outer surface of the roller defines a hollow inner channel, which extends along an axial region of the body. The outer surface is a running surface for a transport belt. An inlet at one end of the hollow inner channel receives air from an air source. Perforations are formed in the outer surface for allowing air pressure to be discharged from the hollow inner channel toward the transport belt. The air diffuses through the transport belt to detack a sheet from the transport belt.

17 Claims, 3 Drawing Sheets

BLOWER ROLL TO ASSIST PAPER DETACK FROM VACUUM TRANSPORTS

BACKGROUND

The present exemplary embodiment relates to a roller to assist in media detack from a vacuum transport assembly. It finds particular application in conjunction with aqueous inkjet continuous feed printer assemblies, and will be described with particular reference thereto. However, it is to be appreciated that the present exemplary embodiment is also amenable to other like applications.

Aqueous inkjet printers employ a printhead(s), which drops liquid ink onto a recording or copy sheet. A schematic side view of a conventional inkjet printer 10 is shown in FIG. 1. Individual recording sheets are removed from the input tray (not shown) and fed onto a transport belt 12 that is driven by rollers 14 beneath a printing member 16. The transport belt 12 includes a plurality of holes, or perforations (not shown), through which vacuum pressure is applied from a vacuum plenum to hold the printing sheet to the belt as it moves through the printer. The conventional printer employs a silicone belt with 6-mm holes over the vacuum plenum. During printing, a recording sheet 17 is held to the transport belt 12 through a printing zone 18 by an applied vacuum from a first vacuum applicator 20. An interdocument region 21 can be located between recording sheets 17 in areas where the transport belt 12 enters an input slot 22 or exits an output slot 24 of a dryer 26. The dryer 26 has attached thereto a second vacuum applicator 28 for further application of a vacuum to the recording sheet 17 through the belt 12 as it traverses through the dryer 26 in the process direction of an arrow 30. The transport belt 12 enables the use of a single transport for both imaging and drying. It is also possible that a single vacuum applicator could be used in both the imaging region and the dryer 26. Once the recording sheet 17 has been dried upon the dryer 26, stripper fingers (not shown) strip the media sheet from the surface of the transport belt 12 and continue to guide the sheet toward an output slot, where the sheet is deposited in an output tray.

As the aqueous ink is jetted onto the media at a high coverage area, it dries at different rates due to the thermal gradients created by the holes in the silicone belts, as well as the edges of each belt when a series of belts is employed. It has been found that the use of conventional perforated vacuum transport belts leaves a visible or perceptible gloss difference or defect in images on the sheets. One primary cause of this defect is a non-uniform temperature gradient on the backside of the sheet or substrate that is caused by differences in heat transfer to/from the solid areas and the perforations in the conventional belts. As a result, a visible defect can be seen in the glossy image as a vacuum belt hole pattern. For printers that employ a series of belts, the thermal gradients at the edges of the belts also create a linear defect in the image.

Therefore, an alternative vacuum transport belt was developed. This belt includes a non-perforated layer that is porous to air for diffusing pressurized airflow, thereby enabling the printing of sheets carrying ink without producing image defects induced by the vacuum belt. The non-perforated layer is a smooth fabric layer that presents airflow to the sheet in a diffused or distributed manner so that the airflow does not create a dramatic temperature gradient over the belt surface.

In order to release media from the hold down force of the vacuum transport belt, a mechanical device, such as the stripper fingers, is often employed with the silicone belt.

These fingers work well on smooth belts, where they come into contact with the perforations in the belt. However, the stripper fingers are observed to not work as effectively on thicker, softer, textured or porous belts. As the stripper fingers strip the media sheets from the surface of the belt, they gouge and rip the fabric material of the belt. Therefore, an improved method and system is desired to detack the sheet from a non-perforated vacuum transport belt. There is further desired a method and system that maintains the belt's porosity over time, by preventing or reducing the clogging that is caused by the vacuum hold down force to dust and other debris.

BRIEF DESCRIPTION

One embodiment of the disclosure is directed to a roller for a transport belt of a vacuum transport assembly. The roller is an elongate cylindrical body adapted for a rotatably fixed connection to the transport assembly. An outer surface of the roller defines a hollow inner channel, which extends along an axial region of the body. The outer surface is a running surface for a transport belt. An inlet at one end of the hollow inner channel receives air from an air source. Perforations are formed in the outer surface for allowing air pressure to be discharged from the hollow inner channel toward the transport belt. The air diffuses through the transport belt to detack a sheet from the transport belt.

Another embodiment of the disclosure is directed to a vacuum transport belt assembly. The vacuum transport belt assembly includes an endless transport belt made from a porous material for moving a sheet through a printer assembly. A vacuum plenum applies vacuum pressure through the transport belt. Specifically, the vacuum plenum holds the sheet to the transport belt by a vacuum drawing air through the transport belt. The vacuum belt assembly further includes one blower roll and at least one other roll to support the belt over the vacuum plenum. The blower roll includes a hollow inner channel extending along an axial region of the blower roll. The blower roll further includes an outer surface that is a running surface for the transport belt. An air intake hole is at one end of the hollow inner channel for receiving air from an air source. Perforations are formed in the blower roll. The perforations allow air pressure to be discharged from the hollow inner channel toward the transport belt. The air diffuses through the transport belt to detack a sheet from the transport belt.

Another embodiment of the disclosure is directed to an image forming apparatus. The image forming apparatus includes an endless transport belt for moving a sheet through the image forming apparatus. A vacuum plenum applies vacuum pressure through the transport belt. The vacuum plenum holds the sheet to the transport belt by a vacuum drawing air through the transport belt. The image forming apparatus further includes at least one of a drive and idle roller for supporting the transport belt over the vacuum plenum. The roller includes a hollow inner channel extending along an axial region of the roller. An outer surface of the roller acts as a running surface for the transport belt. A first end of the roller provides an air intake hole to the hollow inner channel. The air intake hole receives air from an air source. Perforations are also formed in the roller. The perforations allow air pressure to be discharged from the hollow inner channel toward the transport belt. The air pressure diffuses through the transport belt to detack a sheet from the transport belt.

DETAILED DESCRIPTION

Figure 1:
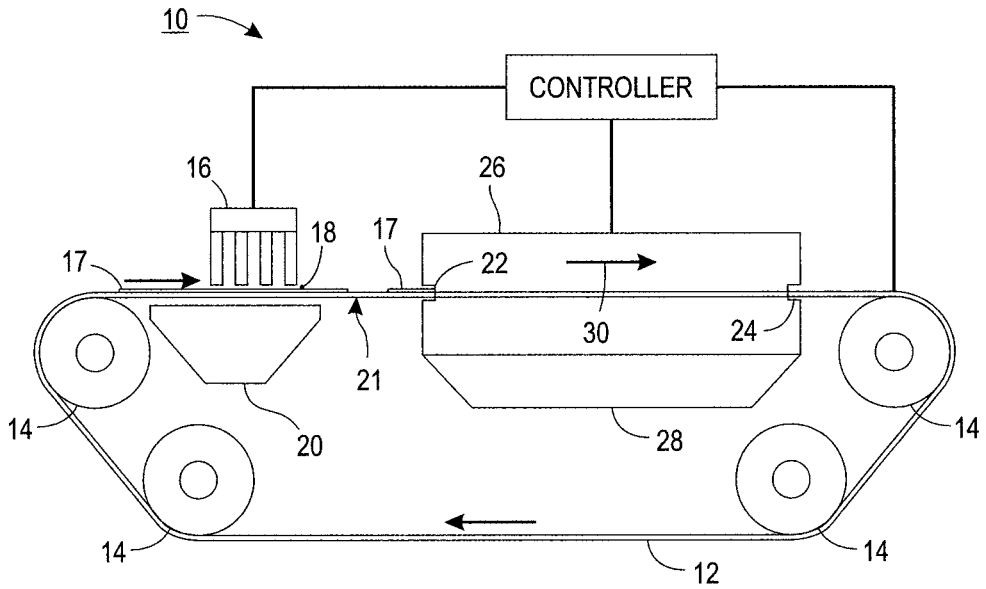
FIG. 1 PRIOR ART
FIG. 1 is a schematic side elevational view of a conventional inkjet printer in the PRIOR ART.

The present disclosure is directed to (1) a roller, which assists in media detack from a vacuum transport assembly; (2) an improved vacuum transport assembly incorporating a blower roll; and (3) an improved image forming apparatus incorporating such vacuum transport assembly. A downstream roller—which is incorporated in a vacuum transport assembly—is defined as a hollow tube having perforations formed through its tubular wall. Air is pumped into an open end of the tube, where it is jetted out through the perforations. The air counteracts the vacuum in the plenum and lifts the leading edge of the media off of the transport belt so that the leading edge can pass under an angled edge guide toward the downstream paper path. While the present disclosure is described in connection with an aqueous inkjet continuous flow printer machine, the features can be incorporated in an electrophotographic printer and like machines.

The details regarding vacuum belts and associated structures were discussed in connection with FIG. 1. FIG. 2 shows a cross-sectional side view of a vacuum transport assembly 100 according to an embodiment of the disclosure. The vacuum transport assembly 100 can be incorporated in an image forming apparatus 101, such as a printer machine. The vacuum transport assembly 100 includes an endless transport (conveyer) belt 102 made from a porous material, such as a polyester, mesh, fiber or woven fabric. Specifically, the vacuum transport assembly 100 employs one permeable fabric belt 102 that is used to convey a substrate 104, such as a coated media, recording sheet, etc., downstream. However, a series of parallel belts may be employed in other embodiments. In the contemplated embodiment, the transport belt 102 has no visible perforations. A vacuum plenum 106 applies vacuum pressure through the transport belt 102. The vacuum plenum 106 holds the sheet 104 to the transport belt 102 by at least one vacuum fan 108 drawing air through the transport belt.

The transport belt 102 is entrained around at least two rollers 110, 112. A sheet 104 acquired on the transport belt 102 is transported by at least one forwarding drive roller 110, which drives the belt in the process direction of arrow 114. The drive roller 110 has a rotatably fixed connection to the vacuum transport assembly 100. The belt 102 is also maintained in tension by blower roll 112. The blower roll 112 is in rotatably fixed connection with the vacuum transport assembly 100. The blower roll 112 can be another drive roller. In such instance, the blower roll 112 can include a drive pulley (116, FIG. 3) and is driven by a rotary drive mechanism (not shown). In another embodiment, blower roll 112 is an idler at the end of the transport assay and rotates freely in the direction of arrow 118. In the contemplated embodiment, the blower roll 112 is downstream from the vacuum fan 108 that pulls air through the transport belt 102. In the illustrated embodiment, the blower roll 112 is located at the exit side of the transport path.

The blower roll 112 has an elongate cylindrical body 120 that is formed from a thick drum wall 122. The drum wall 122 defines a hollow inner channel or cavity 124, which extends along an axial region of the blower roll 112. An outer surface 126 of the drum wall 122 is a running surface for the transport belt 102.

Figure 2:
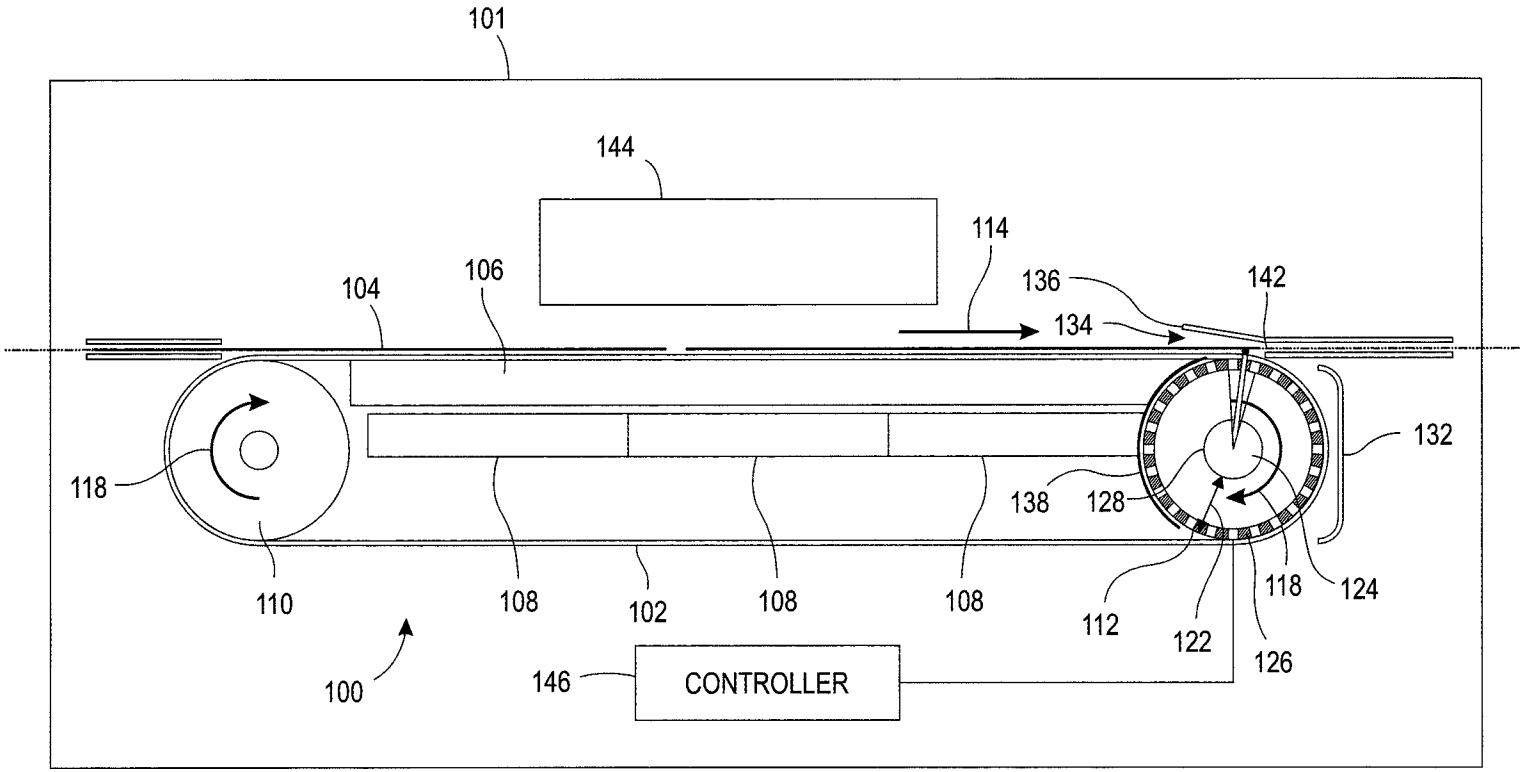
FIG. 2 is cross-sectional side view of a vacuum transport assembly according to an embodiment of the disclosure.
Figure 3:
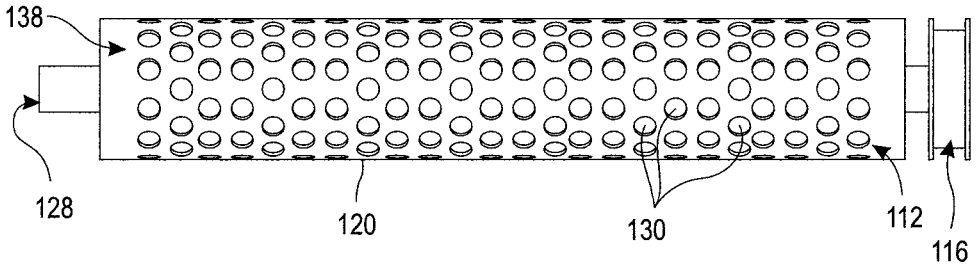
FIG. 3 is a top view of a blower roll incorporated in the vacuum transport assembly of FIG. 2 according to an embodiment of the disclosure.

FIG. 3 is a top view of a blower roll 112 incorporated in the vacuum transport assembly 100 of FIG. 2. An air intake hole 128 or opening at one end of the hollow inner channel 124 receives air from a pressurized air source (not shown), such as a fan. In one embodiment, the blower roll 112 can be coupled to the air source. The hollow inner channel 124 terminates at a closed end, such as an end wall at the opposite end of the air intake hole 128. The blower roll 112 includes multiple perforations 130 formed through the axial section of the body 120 and, more specifically, through the drum wall 122. In one embodiment, the blower roll 112 is a solid metal roll having laser-drilled holes 130 formed through the drum wall 122. In one embodiment, the perforations 130 are approximately between 1-3 mm in diameter, and are spaced apart to cover the entire perimeter/surface of the drum wall 122. The air is blown into the cavity 124 through the air intake hole 128, and the air subsequently jets out from the perforations 130 in the blower roll 112 to provide a gentle air knife type of air force toward the portion of transport belt 102 that is in contact with the outer surface of the body 120. The air diffuses through the transport belt 102 to help separate the sheets from the vacuum transport belt and the vacuum that is applied thereto. The air flowing from the blower roll 112 pushes against the underside of the sheet 104 to separate the sheet from the transport belt 102. The perforated blower roll 112 ensures that the media is disengaged from the vacuum belt 102.

Another aspect of the blower roll 112 is that it assists in cooling the sheet 104. During printing, the sheet 104 is held to the transport belt 102 through a printing zone by the applied vacuum 108. Once the aqueous ink is applied to the sheet 104, the sheet enters a dryer 144 for further application of the vacuum fan 108 to the sheet through the transport belt 102 as it traverses through the dryer 144. The dryer 144 can be a series of IR lamp heaters that is used to dry the ink by evaporating the water and co-solvents from the ink. The dryer 144 can also transfer heat to the sheet 104. Therefore, the air that flows from the blower roll 112 can also act as a cooling source, which cools the sheet after it has been exposed to the dryer 144.

In a similar manner, the dryer 144 can transfer heat to the transport belt 102. Therefore, the blower roll 112 can also act as a cooling source for the transport belt 102 by specifically returning the transport belt to its initial temperature before it is exposed to the dryer 144 as part of the next rotation. Accordingly, such embodiments are contemplated where the transport belt 102 may include a conventional perforated belt. By cooling the transport belt 102 before it re-enters the transport path as part of another rotation, the blower roll 112 can reduce or eliminate any temperature gradients that are due to differences between the solid areas and the perforations on a perforated belt. Therefore, by employing the disclosed blower roll 112 with a perforated belt, the disclosed embodiment reduces and/or eliminates the temperature gradient, and thus the visual defect in the image printed on the sheet.

Another aspect of the present blower roll 112 is that it can evaporate residual water and co-solvents left on the transport belt 102 from the drying aqueous inks.

Another aspect of the present blower roll 112 is that the airflow that discharges from the perforations 130 in the blower roll can assist in cleaning paper dust sucked into the transport belt 102 by the vacuum fan 108, particularly by pushing air through the portion of the porous transport belt 102 that is in contact with the running surface of the blower roll 112. In this manner, the air that is discharged from the blower roll 112 can prevent or reduce clogging of the belt 102. For example, the airflow that is discharged from the blower roll 112 can be used to dislodge paper and media fibers from the belt surface. Paper media also carries a lot of dust, and conventional cloth belt coatings may eventually clog. The perforations 130 in the blower roll 112 function as air jets that blow air at the belt 102, as the belt rolls around the contact surface of the blower roll. This feature prevents clogging and debris build-up to maintain belt porosity over the life of the belt 102.

Returning to FIG. 2, a belt cleaning zone 132 is located at the end of the vacuum transport assembly 100 next to the blower roll 112. Specifically, the belt cleaning zone 132 is a catch wall that is spaced from the outer surface of the body 120. The belt cleaning zone 132 is adjacent to an outfacing portion of the blower roll 112 and, more specifically, is downstream from the blower roll 112. The outfacing portion of the blower roll 112 faces away from the driver roll 110. The wall can include a profile that generally conforms to the outer surface of the blower roll 112, and extends along the longitudinal axis of the body 120. The belt cleaning zone 132 catches and/or collects any residual material and contaminants that is blown off the vacuum transport belt 102.

Continuing with FIG. 1, a media ejecting zone 134 is positioned above the transport belt 102 and the blower roll 112. The media ejecting zone 134 is absent the finger strip or nip assembly that is employed in conventional vacuum transport assemblies. Instead, the media ejecting zone 134 includes an angled edge baffle or guide 136, which captures the sheet 104 as it is pushed away from the transport belt 102 by the air flowing from the blower roll 112. The angled edge guide 136 captures the sheet 104 so that it doesn't fly away from the transport path, and guides the sheet downstream toward a finishing operation or output tray.

Figure 4:
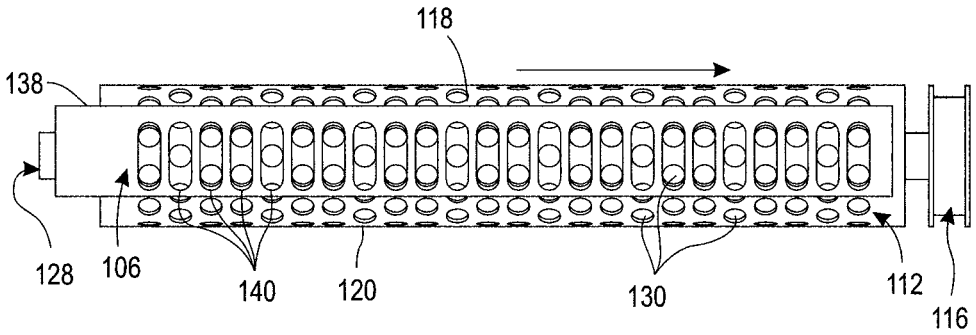
FIG. 4 is a top view of the blower roll according to one embodiment of the disclosure and incorporating an exterior baffle in a first position.
Figure 5:
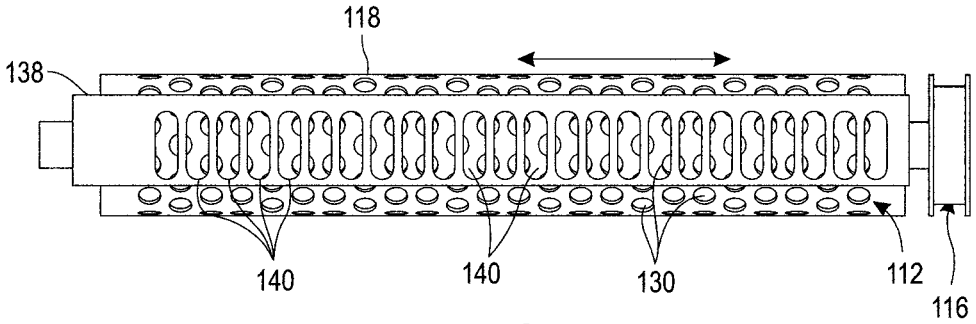
FIG. 5 is a top view of the blower roll of FIG. 4 with the exterior baffle in a second position.

Turning to FIGS. 4 and 5, the blower roll 112 is shown to further include an exterior baffle 138. The baffle 138 is a screen conforming to at least a circumferential portion of the outer surface of the body 120 of the blower roll 112. The baffle 138 also includes at least one slot 140 formed through the screen. In the illustrated embodiment, there are multiple elongate slots 140, but there is no limitation made herein to the shape of each slot or number of slots. In the contemplated embodiment, each elongate slot 140 overlays a portion of the circumferential area in the body 120 of the blower roll 112 such that it overlays multiple perforations 130 in the body. In other words, each elongate slot 140 selectively exposes multiple holes 130 in the body 120 of the blower roll 112. The location of the slots 140 coincides with the location of the multiple perforations 130 in the outer surface.

One aspect of the baffle 138 is that it allows for the airflow to be adjusted based on the weight of the media 104 being moved by the transport belt 102. The baffle 138 controls the airflow and lifting force under the media. Specifically, the baffle 138 is moveable between at least two positions to control the amount of air that is discharged from the hollow inner channel 124. In the contemplated embodiment, the baffle 138 is moveable along a longitudinal length of the body 120. The position of the baffle 138 is determined by properties of the media 104 that is being printed on, such as the weight of the media, malleability of the media, the position of a sheet on a roll, and other factors, such as the dryer temperature, etc.

Returning to FIG. 2, the baffle 138 operates in response to commands sent by a controller 146. In one embodiment, the controller 146 includes a hardware processor that controls the overall operation of the baffle 138 by processor readable processing instructions, which are stored in at least one memory connected to the processor. The processor can be the same or a different processor that controls the vacuum transport assembly 100. In one embodiment, the processor can be communicatively linked to a sensor that is operative to measure a condition, such as the weight of the media or the temperature of the dryer. The processor can store instructions for computing a baffle position based on the sensor measurement. In another embodiment, the processor can be communicatively linked to a user interface device (GUI) via a wired or wireless link. The GUI may include a user input device, such as a keyboard or touch or writable screen, and/or a cursor control device, such as a mouse, trackball, or the like, for communicating user input information and command selections to the processor. The processor can store instructions for controlling a baffle position based on the user input.

FIG. 4 is a top view of the blower roll 112 with the exterior baffle 138 in a first position. The slots 140 extend across the baffle 138 to coincide with—that is, to substantially expose—the perforations 130 in the outer surface of the body 120. This position allows for unrestricted airflow to be discharged from the hollow inner channel 124 and through the slots 140 and the perforations 130 before being diffused through the transport belt 102. Having all or most perforations exposed across the entire surface of the blower roll 112 maximizes the airflow passing through each individual perforation, including the perforations that are in contact with the belt. Accordingly, the baffle is slideable to expose the perforations when heavier media is being printed on.

FIG. 5 is a top view of the blower roll 112 of FIG. 4 with the exterior baffle in a second position. The elongate slots 140 are offset from the perforations 130 to partially or fully cover the perforations in the outer surface. By partially or fully covering the perforations 130 that are adjacent to the exterior baffle 138, the baffle 138 reduces the amount of air flowing through the perforations. Accordingly, the baffle is slideable into the second position when lighter media is being printed on. Therefore, the baffle operates to expose the perforations in the blower roll 112 for heavier media and to cover or partially cover the perforations in the blower roll for lighter media.

There is no limitation made herein to the number of positions that the exterior baffle 138 can achieve. Additionally, other embodiments contemplate a baffle 138 that is moveable along a circumferential extent of the body 120, whereby the elongate or complimentary shaped slots 140 instead extend along the longitudinal extent of the exterior baffle 138.

The sliding baffle 138 enables a controlled airflow through the perforations 130 in the body 120 of the blower roll 112 in lieu of adjusting the air pressure at and from the air source. As viewable in FIG. 2, the external baffle 138 operates with the blower roll 112 to expose or seal the perforations along a circumferential extent or portion of the body 120 that is rotating past the baffle. By doing this along the portion of the blower roll 112 that is proximate the screen, the baffle 138 operates to adjust the amount of air that is flowing through the holes/perforations 130 that are just under the transport belt 102 at the media ejecting zone 134.

Another embodiment of the disclosure contemplates that the position of the exterior baffle 138 is controlled to match the location of the sheet 104 as it moves through the media ejecting zone 134. For example, the exterior baffle 138 can be operative in the first position when the front of the sheet 104 is entering the media ejecting zone 134, particularly to lift the lead edge of the sheet off the transport belt 102. This first, open position would allow the sheet 104 to float into the downstream entrance guide 142. The exterior baffle 138 is operative to close or shift to the second position when the back of the sheet 104 reaches the end of the transport belt 102. In this manner, the exterior baffle 138 covers—essentially closing—the perforations 130 in the body 120 of the blower roll 112 to maintain a drive force between the transport belt 102 and the sheet 104 all the way to the end of the transport belt. This second, closed position would prevent the trail edge of the sheet 104 from flipping up and contacting the edge 136 of the downstream entrance guide 142. The alternating of the baffle 138 between the two positions can be timed based on the spacing between sheets 104, the size or length of the sheet, the rotation speed of the roller 112, and other factors.

In operation, media enters on the upstream side of the transport belt 102, where vacuum pressure is applied below the belt to pull the media against the belt. The media and the belt pass under the IR lamps in the dryer 144, where the water and co-solvents in the aqueous ink are evaporated off of the sheet. As the sheet reaches the downstream end of the vacuum transport assembly, a leading edge of the sheet moves over the blower roll 112. Air flows through the hollow channel and perforations of the blower roll to lift the leading edge of the sheet off of the transport belt, and to float the leading edge of the sheet over the lower baffle on the downstream media path.

In one operation, the exterior baffle slides along a longitudinal extent of the blower roll to cause the slots in the baffle to align with, partially block, or cover the perforations in the blower roll. The baffle controls the airflow and lifting force under the media based on media weight and stiffness, while the remainder of the perimeter holes have an unrestricted airflow to cool and clean the belt. In one mode of operation, the baffle partially covers the perforations of the blower roll that are in contact with the transport belt (i.e., under the transport belt) to reduce the airflow passing through the perforations that are in contact with the belt. In another mode of operation, the baffle exposes the perforations of the blower roll that are in contact with the transport belt (i.e., under the transport belt) to maximize the airflow passing through the perforations that are in contact with the belt. The air being directed to the belt helps cool the belt surface, and can further evaporate co-solvents and/or dislodge contaminants that adhere to the belt surface.

Within the roll is the cavity or plenum, which carries the air to a prescribed area of the roller, where the air then flows through the perforations in the roller and then through the porous or mesh belt to push the sheet off the vacuum transport. Because the sheet enters angled edge guide—which restrains movement of the sheet—the sheet does not blow away from the transport path. Additionally, at all times the sheet has some contact with, or is controlled by, the existing hold down force of the vacuum transport and/or the control provided by the drive and other (such as, nip) rolls.

One aspect of the disclosed embodiments is that they allow a sheet to be disengaged from a vacuum belt in a manner that does not require physical contact with the sheet and/or the belt. The absence of nips and fingers—as part of a sheet release mechanism—prevents the belt from being gouged, ripped, or damaged during the detack procedure.

Another aspect of the disclosed embodiment is the ability to control the amount of airflow being exhausted from the blower roll, specifically by incorporating an exterior baffle that is operable in multiple positions. The exterior baffle is located under the porous belt and is capable of exposing or closing the perforations in the blower roll to control the airflow and the lifting forces on the lead edge of the sheet, as it exits the transport belt. Particularly, the exterior baffle enables the airflow to change for different types of media. The amount of air pressure being discharged from the roller can match the weight of the media that is being printed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A roller for a transport belt of a vacuum transport assembly, the roller comprising:

an elongate cylindrical body adapted for a rotatably fixed connection to the transport assembly, the roller body including:

an outer surface defining a hollow inner channel, the hollow inner channel extending along an axial region of the body, the outer surface being a running surface for a transport belt;

an air intake hole at one end of the hollow inner channel, the air intake hole for receiving air from an associated air source;

perforations in the outer surface, the perforations allowing air pressure to be discharged from the hollow inner channel toward the transport belt, wherein the air diffuses through the transport belt to detack a sheet from the transport belt; and a baffle defined as a screen conforming to at least a circumferential portion of the outer surface of the body;

wherein the baffle is slideable between at least two positions along a longitudinal length of the body.

2. The roller of claim 1, wherein the baffle includes slots formed through the screen;

wherein in response to the baffle being in a first position, the slots coincide with the perforations in the outer surface of the body to allow the air pressure to be discharged from the hollow inner channel; and wherein in response to the baffle being in a second position, the slots are offset from the perforations to partially cover the perforations in the outer surface for reducing a volume of air discharged from the hollow inner channel.

3. The roller of claim 1, wherein the roller is a drive roller including a drive pulley, wherein the roller is driven by an associated rotary drive mechanism.

4. The roller of claim 1, wherein the hollow inner channel terminates at an end wall opposite the inlet.

5. The roller of claim 1, wherein the baffle is moveable along a longitudinal length of the body.

6. The roller of claim 1, wherein the perforations are formed through an axial section of the body.

7. A vacuum transport belt assembly, comprising:

an endless transport belt made from a porous material for moving a sheet through an associated printer assembly;

a vacuum plenum for applying vacuum pressure through the transport belt, the vacuum plenum for holding the sheet to the transport belt by a vacuum drawing air through the transport belt; and a blower roll and at least one other roll for supporting the transport belt over the vacuum plenum, the blower roll comprising:

a hollow inner channel extending along an axial region of the blower roll;

an outer surface being a running surface for the transport belt;

an air intake hole at one end of the hollow inner channel, the air intake hole for receiving air from an air source;

perforations in the blower roll, the perforations allowing air to be discharged from the hollow inner channel toward the transport belt, wherein the air diffuses through the transport belt to detack a sheet from the transport belt;

a baffle defined as a screen conforming to at least a circumferential portion of the outer surface of the blower roll;

wherein the baffle is slideable between at least two positions along a longitudinal length of the body to control an airflow toward the transport belt.

8. The vacuum transport belt of claim 7, wherein the hollow inner channel terminates at an end wall opposite the air intake hole.

9. The vacuum transport belt of claim 7 further comprising:

slots formed through the screen of the baffle;

wherein in response to the baffle being operative in a first position, the slots coincide with the perforations in the outer surface of the drive roller to maximize the air being discharged from the hollow inner channel; and wherein in response to the baffle being operative in a second position, the slots are offset from the perforations in the drive roller to at least partially cover the perforations adjacent to the baffle for reducing the air being discharged through the perforations.

10. The vacuum transport belt of claim 7, wherein the perforations are formed through an axial section of the body.

11. The vacuum transport belt assembly of claim 7, wherein the transport belt is formed from a non-perforated fabric material.

12. The vacuum transport belt assembly of claim 7 further comprising:

a media ejecting zone positioned above the transport belt and the blower roll, the media ejecting zone absent a finger strip or nip, the media ejecting zone comprising an angled baffle for guiding a sheet detacked from the transport belt.

13. An image forming apparatus, comprising:

an endless transport belt for moving a sheet through the image forming apparatus;

a vacuum plenum for applying vacuum pressure through the transport belt, the vacuum plenum for holding the sheet to the transport belt by a vacuum drawing air through the transport belt; and one of a drive and idle roller for supporting the transport belt over the vacuum plenum, the roller comprising:

a hollow inner channel extending along an axial region of the roller;

an outer surface being a running surface for the transport belt;

a first end providing an air intake hole to the hollow inner channel, the air intake hole for receiving air from an air source; and, perforations formed through a drum wall in the roller, the perforations allowing air pressure to be discharged from the hollow inner channel toward the transport belt, wherein the air diffuses through the transport belt to detack a sheet from the transport belt; and a baffle defined as a screen conforming to at least a circumferential portion of the outer surface of the blower roll, wherein the baffle is slideable between at least two positions along a longitudinal length of the body to control an airflow toward the transport belt.

14. The image forming apparatus of claim 13 further comprising:

slots formed through the screen of the baffle;

wherein in response to the baffle being operative in a first position, the slots coincide with the perforations in the outer surface of the roller to allow the air pressure to be discharged from the hollow inner channel; and wherein in response to the baffle being operative in a second position, the slots are offset from the perforations in the roller to partially cover the perforations.

15. The image forming apparatus of claim 13, wherein the perforations are formed through an axial section of the body.

16. The image forming apparatus of claim 13, wherein the transport belt is formed from a non-perforated fabric material.

17. The image forming apparatus of claim 13 further comprising:

a media ejecting zone positioned above the transport belt at the roller, the media ejecting zone absent a finger strip or nip, the media ejecting zone comprising an angled baffle for guiding a sheet detacked from the transport belt.

* * * * *